United States Patent [19]

Das

[11] Patent Number: 4,699,849

[45] Date of Patent: Oct. 13, 1987

[54] METAL MATRIX COMPOSITES AND METHOD OF MANUFACTURE

[75] Inventor: K. Bhagwan Das, Seattle, Wash.

[73] Assignee: The Boeing Company, Seattle, Wash.

[21] Appl. No.: 756,008

[22] Filed: Jul. 17, 1985

[51] Int. Cl.[4] ..... B22F 1/00; B22F 9/00

[52] U.S. Cl. ..... 428/698; 428/379; 428/386; 428/388; 428/389; 428/450; 428/469; 428/902

[58] Field of Search ..... 428/698, 699, 379, 386, 428/388, 389, 450, 469, 902

[56] References Cited

U.S. PATENT DOCUMENTS 4,530,875 7/1985 Donomoto et al. ..... 428/698 X 4,532,182 7/1985 Short et al. ..... 428/698 X 4,559,277 12/1985 Ito ..... 428/698 X 4,569,886 2/1986 Divecha et al. ..... 428/379

*Primary Examiner*—Nancy A. Swisher

*Attorney, Agent, or Firm*—John C. Hammar

[57] ABSTRACT

A metal matrix composite is produced by plastically deforming a metal powder, either before or after blending the powder with ceramic fibers, and compacting the mixture at elevated temperatures to achieve substantially full density. Imparting strain energy to the metal allows reduction of the compaction temperature to eliminate reaction between the fibers and the metal or degradation of the fibers. Silicon nitride fibers are thermodynamically superior for use in aluminum or titanium metal matrix composites, since silicon nitride fibers are more stable at the temperatures required for full compaction. Secondary phase reactions are avoided.

16 Claims, No Drawings

METAL MATRIX COMPOSITES AND METHOD OF MANUFACTURE

TECHNICAL FIELD

The present invention relates to metal matrix composites, and particularly to composites reinforced with silicon nitride fibers.

BACKGROUND ART

Ceramic reinforcement in metal matrices improves the properties or functional characteristics of various metals and alloys. Chopped or continuous fibers, whiskers, or particulates can be used as reinforcement matrix metals to enhance the specific strength (i.e. strength-/density), specific modulus (i.e. modulus/density), and the temperature service capabilities of the composites. Improvement in the specific strength is achievable both by reducing the density and by increasing the absolute strength and modulus through the introducton of the ceramic reinforcement. The result is typically a composite providing a significant weight reduction for components having critical strenth or stiffness requirements For example, a metal matrix composite containing 80 volume % aluminum and 20 volume % silicon carbide has a stiffness comparable to steel, but is considerably lighter. Furthermore, the composite has improved corrosion resistance over steel.

Metal matrix composite research has focused on the development of aluminum based composites using boron, borsic, graphite, or silicon carbide reinforcement in particulate, continuous fiber, or discrete fiber forms. Continuous fibers offer the potential of highly anisotropic properties in the composite by aligning the fibers in primarily one direction. Unfortunately, the off-axis properties of these composites have proven to be quite low. Discontinuous or discrete fibers, however, offer greater potential for tailoring the properties of the composite. For example, by cross-rolling a SiC-Al composite the composite can possess nearly isotropic properties while the same composite may be highly anisotropic if prepared by a multiple extrusion process or if worked with only unidirectional rolling. The degree of stiffness anisotropy can be controlled over a wide range.

Forming composites with continuous or very long fibers often requires highly specialized fabrication techniques to avoid (1), fiber breakage, (2) fiber bunching, (3) nonuniform fiber/matrix interfacial bonding, or (4) void concentrations. Whiskers or particulates are more readily used, particularly in powder metallurgy, casting, hot extrusion, rolling, and forging. Machining, drilling, grinding, joining, and other operations are also more readily accomplished with composites having discrete or discontinuous fibers, since the properties of the composite are not as severely linked to the continuity of the fiber.

When using powder metallurgy to fabricate composites, the metal matrix powder is blended with the fiber and is cold pressed to form a green compact structure. The green structure is then vacuum compacted or isotactically pressed at elevated temperatures and pressures to cure the green structure and to achieve full density in the composite. Full density is necessary to ensure the integrity of the article and to attain the necessary mechanical properties. Unfortunately, the high temperatures required for vacuum compaction to full density can lead to adverse reaction between the fibers and matrix metal, especially for SiC fibers in reactive metals like aluminum and titanium. Such reaction affects the integrity of the composites and their mechanical properties. Secondary phases, such as carbides, borides, silicides or nitrides, can be formed in these reactive composites, and are predictable based upon thermodynamic considerations. Reducing the deleterious reaction between the fibers and matrix is a necessary improvement to metal matrix composite technology.

U.S. Pat. Nos. 4,073,648 (Volin et al.) and 3,976,482 (Larson) disclose inducing strain energy in prealloyed metal powder to improve thermoplasticity of the powder used in specialty superalloys, particularly in powder metallurgy (P/M).

Methods for forming metal matrix composites are illustrated in U.S. Pat. Nos. 3,546,769; 4,060,412; and 4,259,112.

SUMMARY OF THE INVENTION

Loss of mechanical properties in the metal matrix composites of reactive metals is achieved with the selection of silicon nitride fibers that are thermodynamically superior to other reinforcements. Powder metallurgy and vacuum hot compaction techniques can be used without stimulating adverse reactions between the matrix metal and fibers.

By imparting strain energy to the matrix metal, the processing temperature can be reduced, thereby reducing further the risk of adverse fiber/matrix reactions or fiber degradation. Fully dense composites can readily be formed with conventional processing techniques, but at lower temperatures.

The preferred process of the present invention comprises the steps of plastically deforming the matrix metal to impart significant strain energy to the metal, mixing the strain energized metal with ceramic fibers (preferably having an aspect ratio (1/d) of 20-200), and compacting the mixture at elevated temperatures to form a metal matrix composite of substantially full theoretical density. The strain energy stored in the metal allows the compaction to occur at lower temperatures so that adverse reactions do not occur between the fibers and the matrix metal. The required microstructure of the matrix metal is achieved, however, as well as substantially full density. Preferably, the matrix metal is a titanium or aluminum alloy, and the fibers are silicon nitride. Compacting for titanium can, then, occur at a temperature of about 500° to 700° C. and at a pressure of about 50 KSI. For aluminum metal matrix composites, compacting can occur between 500° to 600° C. at a pressure of from 20 to 40 KSI.

The matrix metal and fibers can be mixed prior to imparting the strain energy to the metal. Premixing can result in some breakage of the fibers during the milling, and in reduced mechanical properties. Preferably, the metal is plastically deformed by milling prior to addition of the fibers. Ball milling reduces the likelihood of agglomeration which can occur and which should be avoided.

DESCRIPTION OF THE PREFERRED EMBODIMENTS

The present invention includes a process for manufacturing a metal matrix composite without heating the materials to a point that the fibers degrade or react with the metal. Where the metal of the matrix is an alloy, the metal powder should be pre-alloyed. Titanium and aluminum alloys, such as Ti-10V-2Fe-3Al or CT90 or 7090 aluminum alloy, having 8% zinc, 2.5% magnesium, 1% copper, 1.4% cobalt, and the balance essentially aluminum, may be used in this process. These titanium and aluminum alloys are particulary reactive, so the problems of adverse interfacial reaction between the metals and fibers is particularly acute. The thermodynamic and strain energy concepts of this invention are particularly important for making metal matrix composites from these types of alloys. By plastically deforming the metal to impart significant strain energy to the particles, the temperature of the compaction to achieve full density can be reduced so that the risk of degradation of the fibers or reaction between the fibers and metal is eliminated.

The ceramic fibers usually are silicon nitride whiskers made according to the process of U.S. Pat. No. 4,388,255 to Simpson or of Verzemnieks in his copending patent application, U.S. Ser. No. No. 536,962. An aspect ratio (1/d) of 20–200 is preferred.

Silicon nitride fibers exhibit a standard free energy of formation far more negative than aluminum nitride, titanium nitride, or titanium silicide up to at least about 1400° C. Thus, the fibers are thermodynamically more stable than the reactive metal nitrides so that secondary phases are less likely to form during high temperature processing of aluminum or titanium based metal matrix composites. In contrast, silicon carbide has a more positive free energy than these secondary phases, indicating that aluminum carbide and titanium carbide are likely to form at the elevated processing temperatures.

The matrix metal can be plastically deformed to impart the desired strain energy in a number of ways. Spherical, prealloyed metal particles can be passed through opposed rolls to impart the requisite strain energy. For titanium particles, reducing the diameter by approximately 60 to 80% has proven successful. Deformation to achieve the strain energy can occur even after the particles are mixed with the fibers to form a metal/-fiber mixture. The fibers and metal are blended to form a substantially uniform dispersion so that the physical properties of the resulting article will be uniform. Agglomeration of the fibers during the blending should be avoided. Vibrating the mixture has proven as one means to achieve the desired dispersion.

Plastic deformation (or strain energizing) aids microstructural refinement of the composite during compaction through recrystallization caused by the cold working. The deformation also reduces the effective compaction temperature necessary to achieve full density since diffusion rates of the metal and its flowability are enhanced.

The blended mixture is compacted at elevated temperatures to form a metal matrix composite of substantially full density. Compaction can occur in several steps, and usually entails cold pressing to form a green structure. For titanium alloys, the compacting step can be carried out at a temperature of about 500° to 700° C. and a pressure of about 50 KSI (50,000 lbs. per square inch). For aluminum alloys, it is preferred to compact the material at a temperature of about 500° to 600° C. and a pressure of about 20 to 40 KSI. The maximum compaction temperature depends on the particular alloy and should be below the solidus temperature of the alloy. The compaction pressure depends on the alloy and the morphology of the fibers.

Plastic deformation may not be necessary for aluminum alloy metal matrix composties including silicon nitride fibers, since the alloys have relatively low melting points and are softer than titanium alloys. Even without imparting strain energy to these matrix metals, the processing temperatures may remain low enough that the alloy and silicon nitrides fibers will not react and the fibers will not degrade.

Hot isostatic pressing in a gas pressurized vessel to reach full theoretical density is preferred. Where the article is compacted to an intermediate density prior to compaction to full theoretical density, the initial compaction may either be by hot isostatic pressing, cold pressing at room temperature, or by mechanical compaction where the configuration of the article is amenable to shaping by means of mechanical tooling. Cold pressing is preferred.

The strain energy imparted to the metal allows compaction to full density without detrimental reaction or degradation of the fibers. Heating is required to achieve the desired microstructure of the composite. By imparting strain energy, the temperature can be reduced while the desired properties can be achieved in the composite.

Secondary phases such as aluminum carbide, titanium carbide, titanium silicide, aluminum nitride, or titanium nitride, are brittle phases, and are undesirable in the composites. From a thermodynamic point of view, silicon nitride is far superior to silicon carbide as a fiber candidate for metal matrix composites. Of course, the kinetics of secondary phase reactions must also be considered when selecting a suitable fiber as well as the processing technique. Silicon carbide may be adequate if the processing conditions are such that there is inadequate time for secondary phase adverse reactions to occur.

Silicon carbide-titanium metal matrix composites are subject to stress cracking at high temperature. Silicon nitride-titanium composites of the present invention avoid these problems, exhibit superior strength to density ratios (specific strength), and can be used in applications requiring exposure of high temperatures up to and above 2200° F. These composites of silicon nitride-titanium present substantial weight savings over steels while providing comparable strength and stiffness.

TABLE I

Mechanical Properties of High-Strength CT90 (X7090) Aluminum Alloy Matrix Composites Reinforced With $Si_3N_4$ and SiC (Fibers and Particulates)

| Reinforcement Material | Modulus ($10^6$ psi) | Ultimate Strength (ksi) | Total Strain to Failure (%) |
|---|---|---|---|
| 20 Vol. % $Si_3N_4$ Fibers | 15.0 | 28.0 | 0.27 |
| 20 Vol. % $Si_3N_4$ Particulates | 16.3 | 30.1 | 0.22 |
| 20 Vol. % SiC (F-9) Fibers | 16.4 | 42.7 | 0.44 |
| 20 Vol. % SiC Particulates | 16.8 | 77.3 | 0.64 |
| 20 Vol. % SiC Fibers (Great Lakes) | 16.8 | 40.1 | 0.52 |

Table I shows the mechanical properties of a silion nitride-aluminum composite made in accordance with the invention compared to an aluminum composite having silicon carbide fibers.

With the method of the present invention comparable mechanical properties were achieved. The composites had about a 50% increase in modulus over the unreinforced CT90 or 7090 aluminum alloy. An examination of the microstructure of the silicon nitride composite showed no evidence of interfacial reaction between the fiber and the matrix metal.

In Table I, the aluminum alloy composition (in weight %) was 8% zinc, 2.5% magnesium, 1% copper, 1.4% cobalt, and balance aluminum. Test panels of approximately 8×5×0.05 inches were produced by hot pressing in a die cavity at a temperature of 565° C. The volume fraction of the reinforcing material was in all cases approximately 20%.

A titanium based alloy of the composition, in weight %, 10% vanadium, 2% iron, 3% aluminum, and balance titanium had the particle size distribution of Table II.

TABLE II

| Ti-10-2-3 Strain Energized Power (SEP) Sieve Analysis | | |
|---|---|---|
| | WEIGHT % | |
| U.S. STANDARD MESH SIZE | Can #1 | Can #2 |
| +20 | 1.7 | 1.3 |
| +40 | 17.0 | 10.0 |
| +100 | 65.1 | 71.9 |
| +200 | 13.6 | 15.6 |
| +400 | 2.5 | 1.3 |

This alloy was roll milled prior to blending with fibers to impart strain energy to the particles by a 60–80% reduction in particle diameter. Silicon nitride and silicon carbide fibers,

TABLE III

| FIBER-PARTICULATE MORPHOLOGY | | | | | | |
|---|---|---|---|---|---|---|
| | Fiber Length (microns) | | Fiber Diameter (microns) | | Particulate (microns) | |
| | Mean | Max | Mean | Max | Mean | Max |
| $Si_3N_4$ | 11.1 | 76 | 0.37 | 1.35 | 15.5 | 77.5 |
| SiC | 16.5 | 105 | 1.35 | — | 5.7 | 20 |

characterized as set forth in Table III, were uniformly dispersed in the titanium by vibrating the mixture so that the fibers comprised 10 volume % of the mixture.

Mixtures were loaded into a one-inch diameter die and were cold pressed to achieve a green strength suitable for handling the billet. Each billet was then vacuum hot pressed to obtain a one-inch diameter billet. The compaction conditions of temperature and pressure and resulting composite densities were as set forth in Table IV.

TABLE IV

| VACUUM HOT PRESSED Ti—10V—2Fe—3Al + 10 V/O REINFORCEMENT | | | |
|---|---|---|---|
| FIBER MATERIAL | CONSOLIDATION TEMPERATURE (°C.) | CONSOLIDATION PRESSURE (KSI) | BULK DENSITY (% THEORECTICAL) |
| SiC | 676 | TOOL FAILURE | 88.0 |
| $Si_3N_4$ | 619 | 38.4 | 99.3 |
| $Si_3N_4$ | 580 | 53.2 | 97.9 |
| SiC | 580 | 51.2 | 78-Irregular Shape |
| $Si_3N_4$ | 540 | 51.2 | 85.5 |
| SiC | 540 | 51.2 | 85.7 |

Metallographic examination of the billets showed a uniform dispersion of fibers in the matrix. There was no evidence of chemical reaction between the matrix and the silicon nitride fibers.

These examples show that:

(1) Whisker reinforced Ti-10-2-3 have been successfully consolidated to near theoretical density.

(2) The mixing/blending has been successful in achieving a fairly uniform dispersion of reinforcing fibers in the titanium powder matrix.

(3) The degree of chemical reaction between the reinforcement and the matrix has been minimized through the use of strain energized titanium powders and the concomitant decrease in the processing temperature.

While preferred embodiments have been described, those skilled in the art will readily recognize variations, modifications, or alterations which might be made to the embodiments without departing from the inventive concept. Therefore, the invention should be interpreted broadly. The examples are meant to illustrate the invention and not to limit it. The claims should be interpreted broadly to cover the invention and should only be limited as is necessary in view of the pertinent prior art.

What is claimed is:

1. A metal matrix composite comprising:

a matrix metal selected from the group of alloys consisting of titanium and aluminum alloys, the metal having been compacted to near full theoretical density at elevated temperatures and pressure; and silicon nitride fibers uniformly dispersed throughout the matrix metal, the composite being further characterized by the absence of substantially any evidence of interfacial reaction between the metal and the fibers.

2. The composite of claim 1 wherein the fibers comprise about 10 to 20% by volume of the composite.

3. The composite of claim 2 wherein the metal is a titanium alloy.

4. The composite of claim 2 wherein the metal is an aluminum alloy.

5. The composite of claim 2 wherein the fibers are uncoated.

6. The composite of claim 1, wherein the fibers are whiskers.

7. A metal matrix composite comprising an aluminum alloy or titanium alloy and ceramic fiber whiskers formed by compacting a substantially uniform dispersion of matrix metal and fibers to substantially full theoretical density at an elevated temperature and pressure, the composite being characterized by having essentially no evidence of secondary phase reaction at the interface between the metal and fibers.

8. The composite of claim 7 wherein the whiskers are silicon nitride.

9. The composite of claim 8 wherein the alloy is an aluminum alloy.

10. The composite of claim 8 wherein the alloy is a titanium alloy, and wherein the alloy is plastically deformed prior to compacting to reduce the compacting processing temperature.

11. The composite of claim 7 wherein the fibers comprise about 10-20 volume % of the composite.

12. The composite of claim 10 wherein the fibers are uncoated.

13. The composite of claim 7 wherein the fibers are uncoated.

14. A metal matrix composite comprising a substantially full density compact including Ti-10-2-3 alloy and about 10-20 volume % silicon nitride fibers substantially uniformly dispersed throughout the titanium alloy, the composite being further characterized by having essentially no evidence of secondary phase reaction at the fiber/metal interface.

15. The composite of claim 14 wherein the fibers are discontinuous whiskers having an aspect ratio of about 20-200.

16. A metal matrix composite consisting essentially of a titanium alloy matrix metal and $Si_3N_4$ whiskers, the titanium alloy matrix metal being plastically deformed prior to compaction with the whiskers, the composite being characterized by essentially no secondary phase reaction at the interface between the metal and whiskers and being of substantially full theoretical density.

* * * * *